US005279414A

United States Patent [19]

Brasher

[11] Patent Number: 5,279,414

[45] Date of Patent: Jan. 18, 1994

[54] GOLF CLUB BAG WITH CLUB COMPARTMENTS

[76] Inventor: J. W. Brasher, 1517 Seacliff Dr., Gautier, Miss. 39553

[21] Appl. No.: 960,006

[22] Filed: Oct. 13, 1992

[51] Int. Cl.[5] ..... A63B 55/00; A63B 55/02

[52] U.S. Cl. ..... 206/315.6; 206/315.3

[58] Field of Search ..... 206/315.2, 315.3, 315.6, 206/315.5

[56] References Cited

U.S. PATENT DOCUMENTS

| | | | |
|---|---|---|---|
| 1,417,380 | 5/1922 | Hatch | 206/315.6 |
| 1,563,816 | 12/1925 | Worthington | 206/315.2 |
| 1,570,500 | 1/1926 | Kennedy | 206/315.6 |
| 1,726,245 | 8/1929 | Shelton | 206/315.6 X |
| 1,770,060 | 7/1930 | Barlow | 206/315.6 |
| 1,840,183 | 1/1932 | Blitch | 206/315.6 |
| 1,849,610 | 3/1932 | Boyce | 206/315.6 |
| 1,956,008 | 4/1934 | Deibel | 206/315.6 |
| 2,367,234 | 1/1945 | Mitchell | 206/315.2 |
| 2,549,055 | 4/1951 | Burton, Jr. | 206/315.6 |
| 2,551,780 | 5/1951 | Wood | 206/315.6 X |
| 2,590,154 | 3/1952 | Burns | 206/315.2 X |
| 2,799,315 | 7/1957 | Strasburg | 206/315.2 |
| 3,014,595 | 12/1961 | Bartmann | 206/315.3 X |
| 3,425,708 | 2/1969 | Sato | 206/315.6 X |
| 3,756,299 | 9/1973 | Simmons et al. | 206/315.3 X |
| 4,130,153 | 12/1978 | Zopf | 206/315.6 |
| 4,245,684 | 1/1981 | Street et al. | 206/315.6 X |
| 4,383,563 | 5/1983 | Kirchhoff, Jr. | 206/315.2 |
| 4,522,299 | 6/1985 | Clark et al. | 206/315.3 |
| 4,779,725 | 10/1988 | Gerber | 206/315.3 |
| 5,042,654 | 8/1991 | Jones | 206/315.3 |
| 5,099,990 | 3/1992 | Antonious | 206/315.6 |
| 5,103,974 | 4/1992 | Antonious | 206/315.6 |

FOREIGN PATENT DOCUMENTS

| | | | |
|---|---|---|---|
| 21884 | 8/1930 | Australia | 206/315.5 |
| 9118650 | 12/1991 | PCT Int'l Appl. | 206/315.3 |
| 2130102 | 5/1984 | United Kingdom | 206/315.6 |

*Primary Examiner*—Sue A. Weaver

*Attorney, Agent, or Firm*—Pravel, Hewitt, Kimball & Krieger

[57] ABSTRACT

An new concept golf club bag which accommodates the clubs with the club heads down, providing a central hollow core element positioned within the length of the bag, for defining a central elongated central core, and an outer club area between the core element wall and the outer wall of the bag. The outer club area is divided into a plurality of club spaces formed by a plurality of spaced-apart wall partitions, so that an iron club can be placed in a protected position within each partitioned area. The outer club area is provided with a raised floor portion off the bag floor, so that the shorter irons are at a depth to allow the upper ends of the clubs to be readily accessible with the open end of the bag. Further, the lower end of the core element is provided with a cone positioned on the floor of the bag, with a plurality of upright dividers defining a space for accommodating the club head of the woods within the space, so that when in position, each wood face is slid along the cone surface into a protected position in a separate space defined by the dividers and below the raised floor supporting the irons. On the upper core inner wall, there is provided a plurality of plastic elements to allow the shaft of each wood to be secured along the wall of the core to prevent movement.

14 Claims, 3 Drawing Sheets

GOLF CLUB BAG WITH CLUB COMPARTMENTS

BACKGROUND OF THE INVENTION

1. Field Of The Invention

The apparatus of the present invention relates to golf bags. More particularly, the present invention relates to a new concept for a golf bag which allows the clubs to be positioned with the clubheads in the down position, and the irons and the woods within separate compartments and at different levels within the bag.

2. General Background

In the sport of golf, it is imperative that the golfer maintain the broad array of clubs within a suitable bag which can accompany the golfer on the course, and which allows easy selection of the proper club depending on the shot. In addition, it is valuable that the expensive clubs be maintained within the bag in a position where they are protected from damage and easily identified and retrieved.

In the present state of the art, the most typical type of golf bag construction provides in general an open top bag, circular in cross section, and having a single floor where the clubs rest. The clubs are positioned within the bag, with the club heads up, in a disorderly manner. However, because of the nature of golf clubs, in general, the woods are substantially longer than the irons and the putter. Therefore, when the clubs are in the bag, the woods tend to extend a distance out of the open end of the bag, with the irons generally confined within the bag. This leads to the iron club heads banging against the shafts of the wood clubs. Therefore, when one wishes to protect the clubs from damage, club head covers must be used with each play. This delays the game and is a nuisance. Another problem is that unless the bag is specifically adapted with individual club tubes for positioning the clubs in each tube, the clubs rattle around the bag as the bag is moved during play. This leads to damaging of clubs and a generally annoying situation. Another problem is that the clubs are stored in a random manner requiring time to identify the desired club.

There have been patents issued in the art which address golf bag construction, and these are cited in the list of art which is being submitted herewith, or shortly after filing of the application for letters patent.

Other objects of the invention will be obvious to those skilled in the art from the following description of the invention.

SUMMARY OF THE PRESENT INVENTION

The apparatus of the present invention solves the problems confronted in the art in a simple and straightforward manner. What is provided is a new concept for a golf club bag which accommodates the clubs with the club heads down within individual designated storage compartments. There is provided a central hollow core element provided along the length of the bag, for defining a central elongated central core for wood clubs, and an outer club area between the core element wall and the outer wall of the bag. The outer iron club area is divided into a plurality of club housings formed by a plurality of spaced-apart wall partitions, so that an iron club can be placed within each partitioned area. The outer club area is provided with its own separate raised floor, for iron club storage, off the bag floor, which holds the wood clubs, so that the shorter irons are at a depth to allow the upper ends of the clubs to be readily accessible at the open end of the bag. Further, the lower end of the core element is provided with a cone positioned on the floor of the bag, with a plurality of upright dividers defining a space for accommodating the club head of the woods within the space, so that when in position, each wood face is slid along the cone surface into a separate space defined by the dividers and below the raised floor supporting the irons. On the upper core inner wall, there is provided a plurality of plastic friction grips to allow the shaft of each wood to be secured along the wall of the core to prevent movement. Further, there is provided a channel for housing golf balls within the channel, a tee storage area and of course the necessary pockets in the bag for storing other necessities particular to the game of golf.

Therefore, it is a principal object of the present invention to provide a new concept golf bag where the irons are positioned within individual club spaces, and the woods are positioned within the central portion of the bag, with each irons and woods resting on floor portions of differing levels within the bag;

It is a further object of the present invention to provide a new concept golf bag which provides for easy storage of irons and woods apart from one another, and secured in place, with the ends of the clubs in the up position and the heads of the clubs resting on floor portions within the bag;

It is a further object of the present invention to provide a new concept golf bag with an orderly arrangement of designated club storage areas rather than a random disorderly array;

It is a further object of the present invention to provide a new concept golf bag which incorporates the several new concepts and still retain the versatility for use with modern day golf carts and pull carts; and It is a further principal object of the present invention to provide a new concept golf bag where the clubs are positioned club head down and the club grips are readily accessible at the upper end of the bag.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
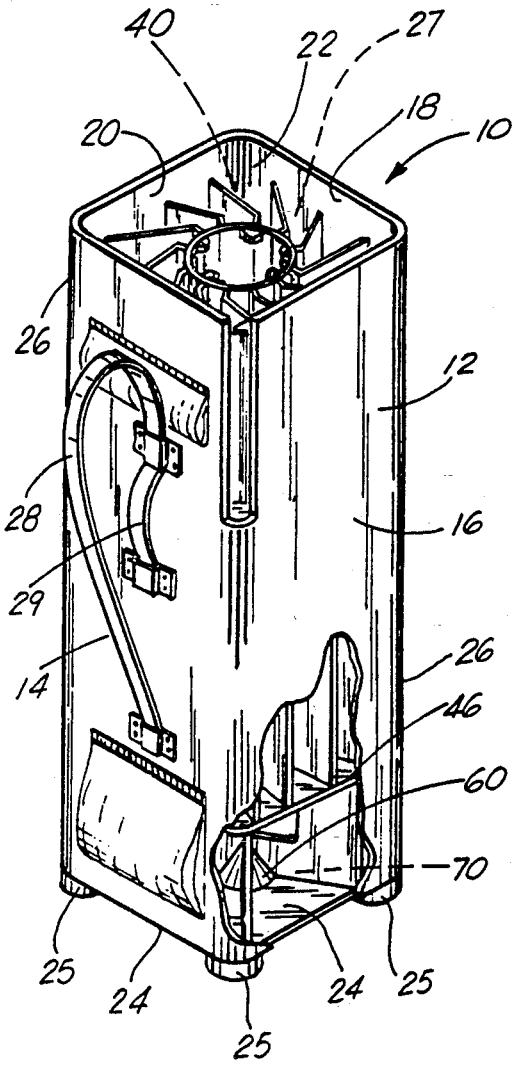
FIG. 1 illustrates an overall view of the preferred embodiment of the present invention.

FIGS. 1 through 6 illustrate the preferred embodiment of the present invention by the numeral 10. As illustrated in overall view in FIG. 1, golf bag 10 comprises a generally rectangular upright body portion 12, which comprises four side walls 14, 16, 18, 20, an open top end 22, and a base portion 24, with a plurality of feet 25 to support the bag off the ground. As illustrated, golf bag 10 is rectangular, with rounded corners 26, but it could be other shapes such as circular, oval, or the like. The bag would be generally constructed, as are most golf bags, of a soft material, such as a leather covering, with an internal support frame of plastic or other suitable material, as will be discussed.

As seen further in FIG. 1, bag 10 also would include a shoulder strap 28, and a handle 29, as is typical of most golf bags.

Figure 2:
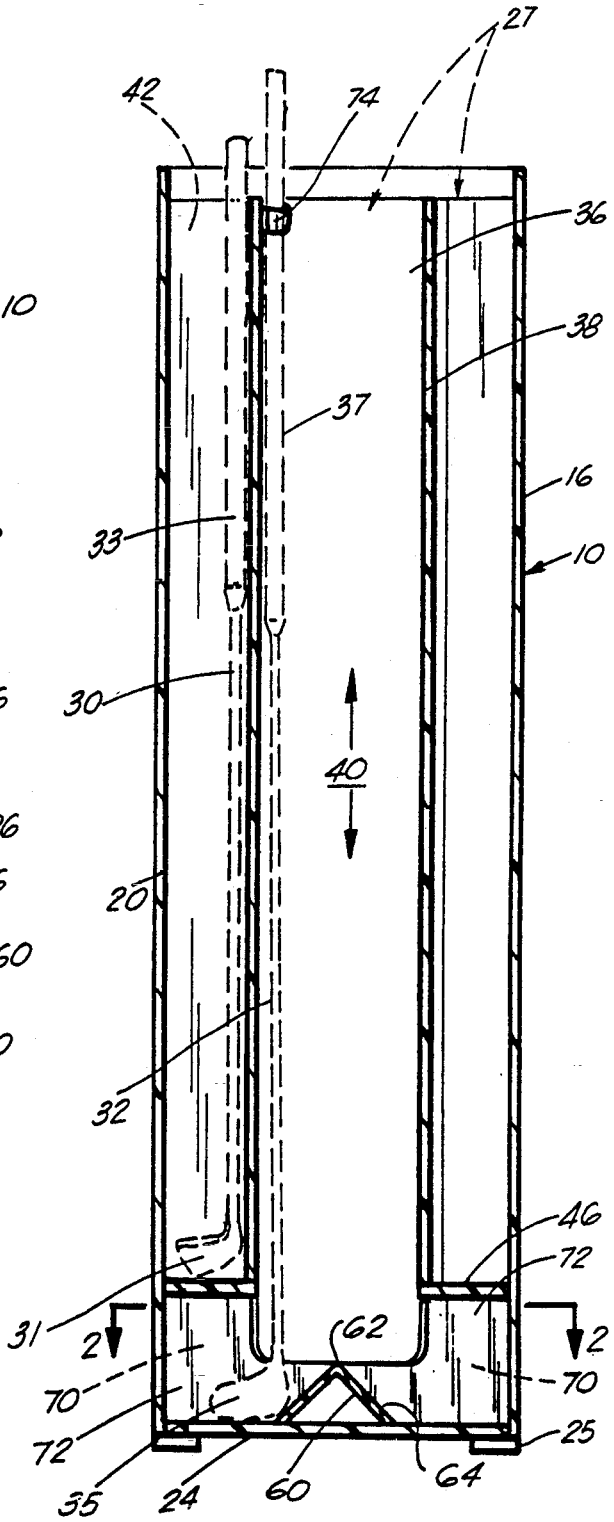
FIG. 2 illustrates a side cross-section view of the preferred embodiment of the present invention.

Turning now to the internal construction, FIG. 2 illustrates bag 10 in cross section view. As illustrated golf bag 10 comprises in general a means to allow the iron clubs 30, as seen in FIG. 2, to be positioned within the internal space 27 with the heads 31 of the iron clubs 30 resting on a raised floor portion 46 and the wood clubs 32 positioned with the heads 35 resting on the base portion 24 of the bag 10. This means comprises first a centrally located hollow core element 36, having a continuous side wall 38, and defining a club storage space 40 therewithin. As seen, core element 36 extends from near the top end 22 of bag 10 through the center of the internal bag space 27, for dividing the internal space 27 into an outer annular space 42 between the core element wall 38 and the bag side walls, and an inner core space 40 within the core element. The two spaces generally provide the two means in which the irons are stored separate and apart from the woods and from each other.

Figure 3:
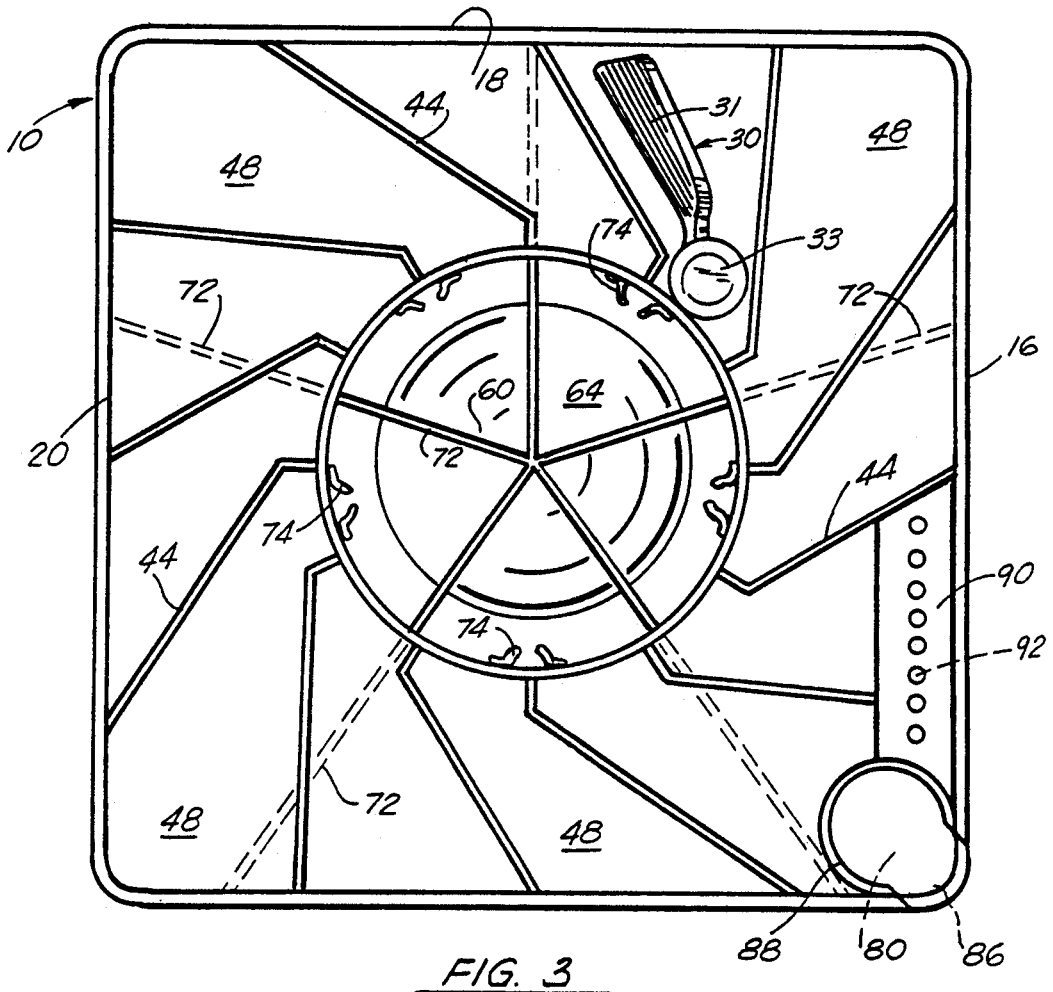
FIG. 3 illustrates a top view of the preferred embodiment of the present invention.

Turning first the annular space 42, reference is made to FIGS. 2 and 3 where there is illustrated space 42 for storage of the irons 30. Space 42 would be further provided with a plurality of partition walls 44, each wall extending from near the top 22 of the bag, and terminating at a raised floor portion 46, as seen in FIG. 2. The partitions would define a club space 45 between each pair of partitions as seen in exploded view in FIG. 5 and in top view in FIG. 3. As seen the partition walls 44 would be so constructed so as to form a lower space 48 substantially in the shape of an iron head 31, as seen in top view in FIG. 3, where the iron head 31 is illustrated. It should be made clear that the outer annular space 42 requires a raised floor 46 from the base 24, due to the fact that the irons 30, as seen in FIG. 2, are shorter than the woods 32, and in order for the handle portion 33 of the irons to be the similar height as the handle portions 37 of the woods 32, the irons 30 must be positioned in a raised position.

Figure 4:
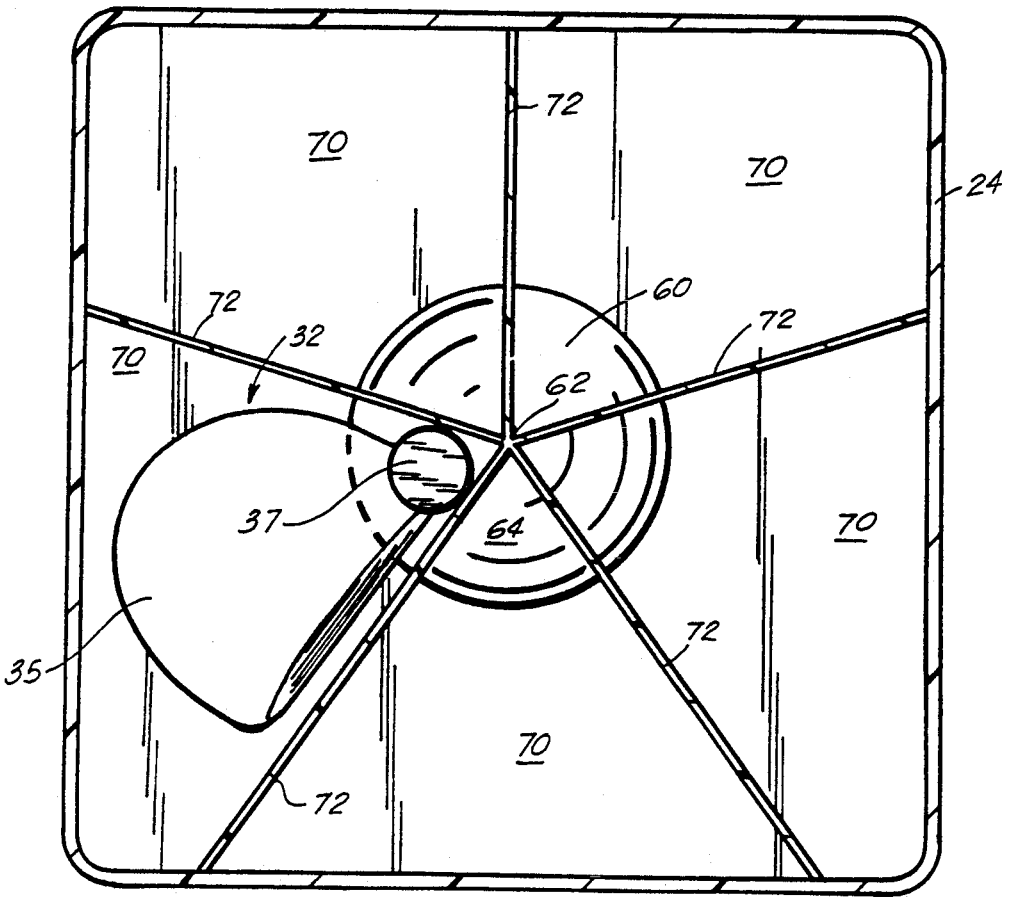
FIG. 4 illustrates a top view along lines 2—2 in FIG. 2 of the preferred embodiment of the present invention.

Turning now to the internal core space 40, reference is made to FIGS. 1, 2, and 4. This space is used to house the woods 32, which generally comprise five clubs; i.e., a driver and four other woods. As seen, unlike the annular space 42 housing the irons, the woods 32 are positioned within the core space 40 and a wood head storage space 70, with no partitions extending the length of the core element wall 38. Rather, below the base of the core element 36, there is positioned a cone element 60 positioned on the base 24 of the bag 10, and centrally located so that the apex 62 of the cone 60 is centrally located at the base of the core space 40. The cone 60 serves as a means to allow the head portion 35 of each of the woods 32 to slide along the angulated cone surface 64 when the club head makes contact with the cone 60.

Figure 5:
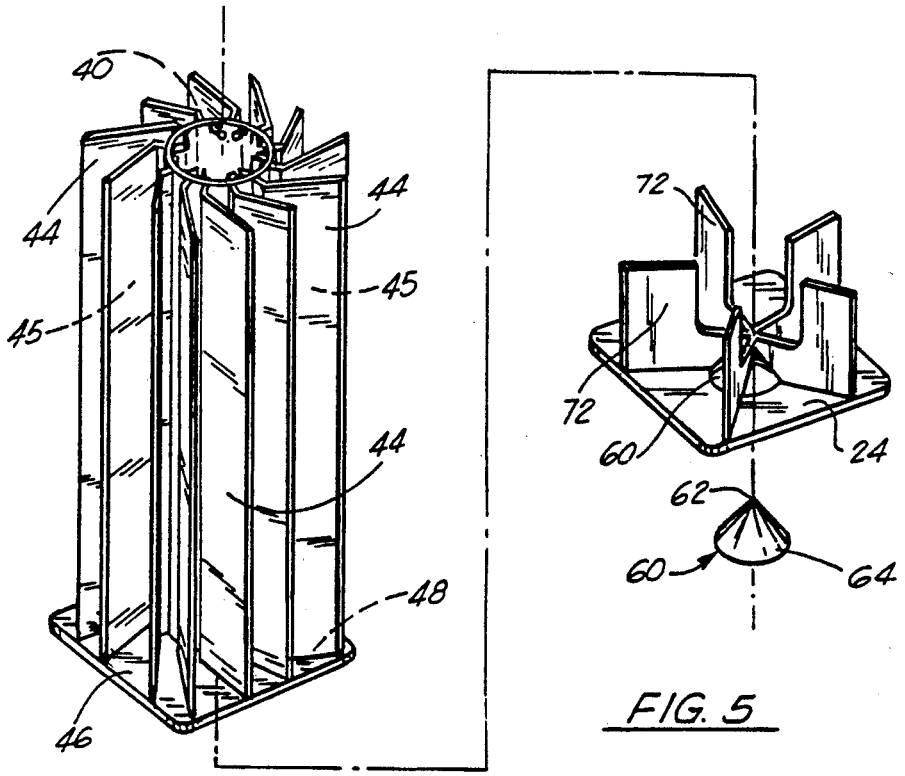
FIG. 5 illustrates a partial exploded view of the partition assembly for housing the irons and the woods in the preferred embodiment of the present invention.

As illustrated further in FIGS. 1, 2 and 5, although there are no partitions extending throughout the core element 36, as stated earlier, there is a means, at the base of the bag functioning in conjunction with cone 60 which defines the separate wood head storage space 70 for each of the wood heads 35. This means comprises a plurality of divider members 72, positioned at the apex 62 of the cone 60, with each adjacent pair of dividers defining a wood head space 70. As seen in FIG. 2 this space, which would extend outward from cone 60, is the space which is established between the raised floor 46 accommodating the irons, and the base 24 of bag 10. Therefore, when a wood 32 is slid down the core space 40 and into the core element space 70, the head 35 makes contact with the cone 60, and the wood head 35 will slide down cone surface 64 into one of the available five spaces 70 defined by the divider members 72. Since the handles 37 of the woods 32 are not confined within individual spaces as are the heads 35, FIG. 3 illustrates a plurality of plastic clip members 74 which are positioned above each wood space 40 along the top wall of the core element 36, so that following the positioning of the club head 35 in each space 70, the handle 37 of the wood 32 is clipped into a clip member 74 and held secure until ready for use.

Figure 6:
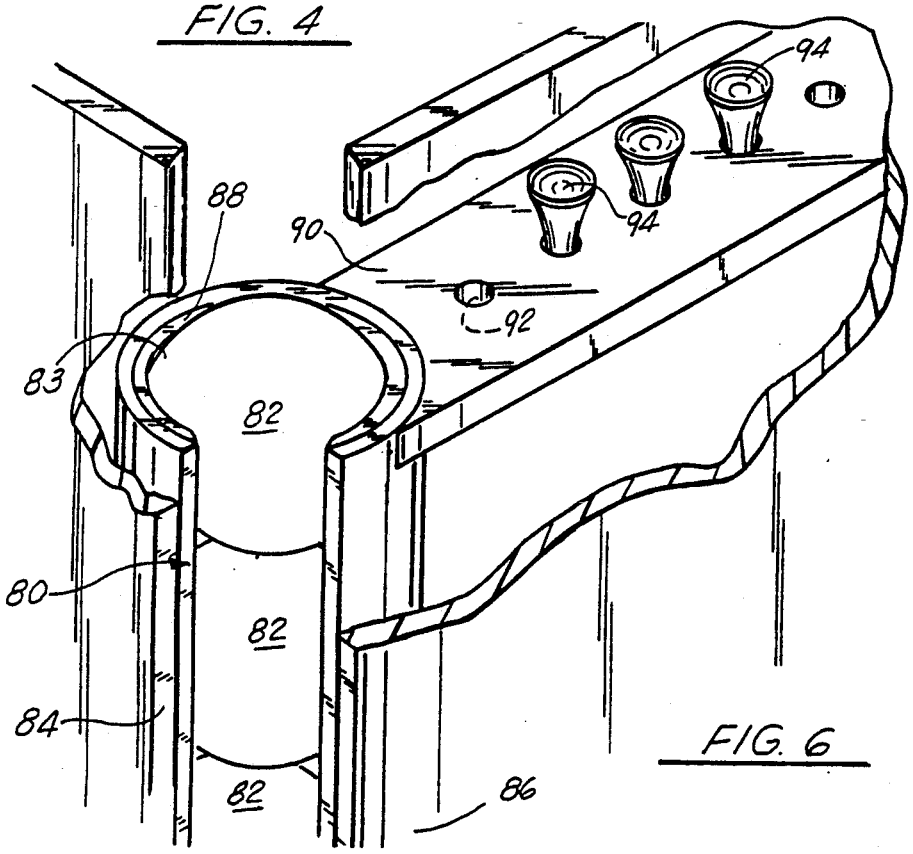
FIG. 6 illustrates a partial view of the golf ball housing channel in the preferred embodiment of the present invention.

Turning now to additional features of the bag, reference is made to FIG. 6 where there is illustrated a means for holding a plurality of golf balls. As seen in that figure and also in FIG. 1, this means comprises a channel 80 running along, preferably a corner of the bag, circular in cross section and of a desired diameter to easily house a plurality of golf balls 82 retrievable through a top opening 83 in channel 80. The channel 80 would be formed by tubular wall 84, having an elongated slot 86 along its length so that one could make contact with a ball 82, and push the top ball 82 out of the channel 80 through top opening 83. In order to hold the ball 82 in place, there would be provided a flexible lip around the upper opening 83 in channel 80, so that the ball would be removed only after flexing the lip 88 outward to accommodate passage of the ball through the opening 83.

As seen further in FIG. 6, there is provided a flat deck 90 with ports 92 for accommodating a series of tees 94 for easy access adjacent the ball channel 80. Of course, the bag would be provided with the usual pockets or the like which would be typical of any golf bag. Also, since the clubs are positioned club head down, it would be necessary to mark each club compartment with the club number for easy retrieval. The club handle could also be marked. Also, since the clubs are substantially confined within the bag, the bag could easily be provided with a removable top portion to close off the bag from the elements.

Glossary of Terms:

golf bag 10
body portion 12
side walls 14, 16, 18, 20
top end 22
base portion 24
feet 25
rounded corners 26
shoulder strap 28
handle 29
iron clubs 30
iron head 31
iron handle 33
internal space 27
wood clubs 32
wood head 35 wood handle 37
core element 36
side wall 38
wood club space 40
outer annular space 42
partition walls 44
iron club space 45
raised floor portion 46
iron club head storage space 48
cone element 60
apex 62
angulated cone surface 64
wood club head storage space 70
wood divider members 72
clip members 74
channel 80
golf balls 82
top opening 83
tubular wall 84
elongated slot 86
flexible lip 88
flat deck 90
ports 92
tees 94

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An improved golf club bag, comprising:

a) an elongated primary club storage portion defined by sidewalls, a base, and an open upper end;

b) means positioned within the primary club storage portion for dividing the portion into a first central core club storage space for woods, and a second club storage space for irons;

c) partition means spaced around the club storage space for defining individual storage slots for an iron;

d) a secondary floor portion raised from the base, within the storage space for resting the club head of the iron on the secondary floor portion;

e) means at the lower end of the first central core club storage space for directing a club head of a wood into a lower space formed between the bag base and the secondary floor portion; and f) means for dividing the lower space into a plurality of storage compartments for the head of each of the woods placed within the first central core club storage space.

2. The golf club bag in claim 1, further comprising an elongated channel for storing a plurality of golf balls retrievable through an upper opening in the channel.

3. The golf club bag in claim 1, further comprising a plurality of clip members positioned on a wall of the central core club storage space for engaging the upper handles of the woods in stationary position.

4. The golf club bag in claim 1, wherein the golf club bag is generally rectangular in cross-section.

5. The golf club bag in claim 1, wherein the means for dividing the primary club storage portion further comprises an elongated core element having a central opening therethrough, and extending substantially the length of the bag.

6. The golf club bag in claim 1, wherein the storage slots for irons are shaped generally in the shape of the head of an iron.

7. The golf club bag in claim 1, wherein the means for directing the club heads of the woods into the lower space further comprises a cone, having an apex and an angulated side wall, for allowing the club head to slide down the side wall and into the lower space.

8. An improved golf club bag, comprising:

a) an elongated primary club storage portion defined by sidewalls, a base, and an open upper end;

b) an elongated, hollow core element positioned within the primary club storage portion for dividing the portion into a first central core club storage space formed by the hollow core element;, and a second annular club storage space formed between a wall of the core element and the sidewalls walls of the bag;

c) partition walls spaced apart within the annular club storage space for defining individual storage slots for an iron;

d) a secondary floor portion raised from the base, within the annular storage space for resting the club head of the iron on the secondary floor portion;

e) means at the lower end of the central core club storage space for directing a club head of a wood into a lower space formed between the bag base and the secondary floor portion; and f) means for dividing the lower space into a plurality of storage compartments for the head of each of the woods placed within the core club storage space.

9. The golf club bag in claim 8, further comprising a plurality of clip members positioned on a wall of the core element for engaging the upper handles of the woods in stationary position.

10. The golf club bag in claim 8, wherein the storage slots for irons would be shaped generally in the shape of the head of an iron.

11. The golf club bag in claim 8, wherein the means for directing the club heads of the woods into the lower space further comprises a cone, having an apex and an angulated side wall, for allowing the club head to slide down the side wall and into the lower space.

12. The golf club bag in claim 8, further comprising an elongated channel for storing a plurality of golf balls retrievable through an upper opening in the channel.

13. The golf bag in claim 12, wherein the elongated channel further comprises a flexible lip along the upper opening for maintaining the golf balls within the channel until manually retrieved.

14. The golf bag in claim 8, further comprising means to secure tees and other golf accessories on the bag.

* * * * *